United States Patent [19]

Shiang et al.

[11] Patent Number: 5,038,992

[45] Date of Patent: Aug. 13, 1991

[54] STRUCTURE OF STAPLER

[76] Inventors: Liou H. Shiang, 3fl., 3-2, 2 Alley, 90 Lane, Yung Ho Rd., Chung Ho City; Chen C. Jang, 16, Yung An, Wu Ma Tsun, Lin Nei Hsiang, Yuen Lin Hsien; Chen S. Duen, 50, Kwang Rd., Lin Chung Tsun, Lin Nei Hsiang, Yuen Lin Hsien; Lay K. L. Sheue, 9, 31 Lane, Chien Kuo Rd., Hsin Chuang, all of Taiwan

[21] Appl. No.: 468,371

[22] Filed: Jan. 22, 1990

[51] Int. Cl.[5] ..... B25C 5/11

[52] U.S. Cl. ..... 227/120; 227/139

[58] Field of Search ..... 227/120, 139

[56] References Cited

U.S. PATENT DOCUMENTS 4,691,853 9/1987 Storace ..... 227/120 X 4,795,073 1/1989 Yamamoto et al. ..... 227/120

FOREIGN PATENT DOCUMENTS 1246575 10/1960 France ..... 227/120

*Primary Examiner*—Timothy V. Eley

*Attorney, Agent, or Firm*—Ostrolenk, Faber, Gerb & Soffen

[57] ABSTRACT

A stapler for paper binding utilizes a supporting means to firmly support staples so as to make binding process easy and stable. A stapler of the present invention includes a pressure plate spring received in a pressure bar pivoted to a front-opened cartridge. The pressure plate spring includes a front striking plate and a front bumper to drive a staple for binding papers and to confine such a staple from forward inclination. A supporting wedge is received in the staple cartridge to slide in the front and to firmly support the staple which is driven downward for binding papers. Through the support of the supporting wedge and the front bumper of the striking plate of the pressure plate spring, staple is protected to straightly strike downward for binding papers efficiently.

9 Claims, 2 Drawing Sheets

STRUCTURE OF STAPLER

BACKGROUND OF THE INVENTION

This invention relates to a stapler for driving staples through paper as for binding pamphlets.

In conventional staplers or stapling machines, staples are received in a staple cartridge and bilaterally supported by the bilateral side walls of such a staple cartridge. If to bind up a big amount of papers at a time, staples may be distorted during downward striking and become unable to penetrate through the papers.

It is therefore, the main object of the present invention to provide such a stapler which includes a front-opened staple cartridge having received therein a supporting wedge to slide in the front and to stably support staples during downward striking so as to make binding process smooth and easy.

Another object of the present invention is to provide such a stapler which includes a staple cartridge having the two front upper portions of its two side walls respectively turned inward to form two projecting ends which are respectively connected together through a tongue and a retaining groove respectively made thereon such that the two side walls thereof are firmly retained to bilaterally support the staples received therein.

A yet further object of the present invention is to provide such a stapler which includes a pressure plate spring having an unitary push rod extending downward inward therefrom to constantly press on the rear upper end of a feed slide in a staple cartridge so as to push such a feed slide forward during staple driving operation and to prohibit staples from backward sliding.

Embodiments of the present invention will now be described by way of example with reference to the annexed drawings, in which:

DETAILED DESCRIPTION OF THE PREFERRED EMBODIMENTS

Figure 1:
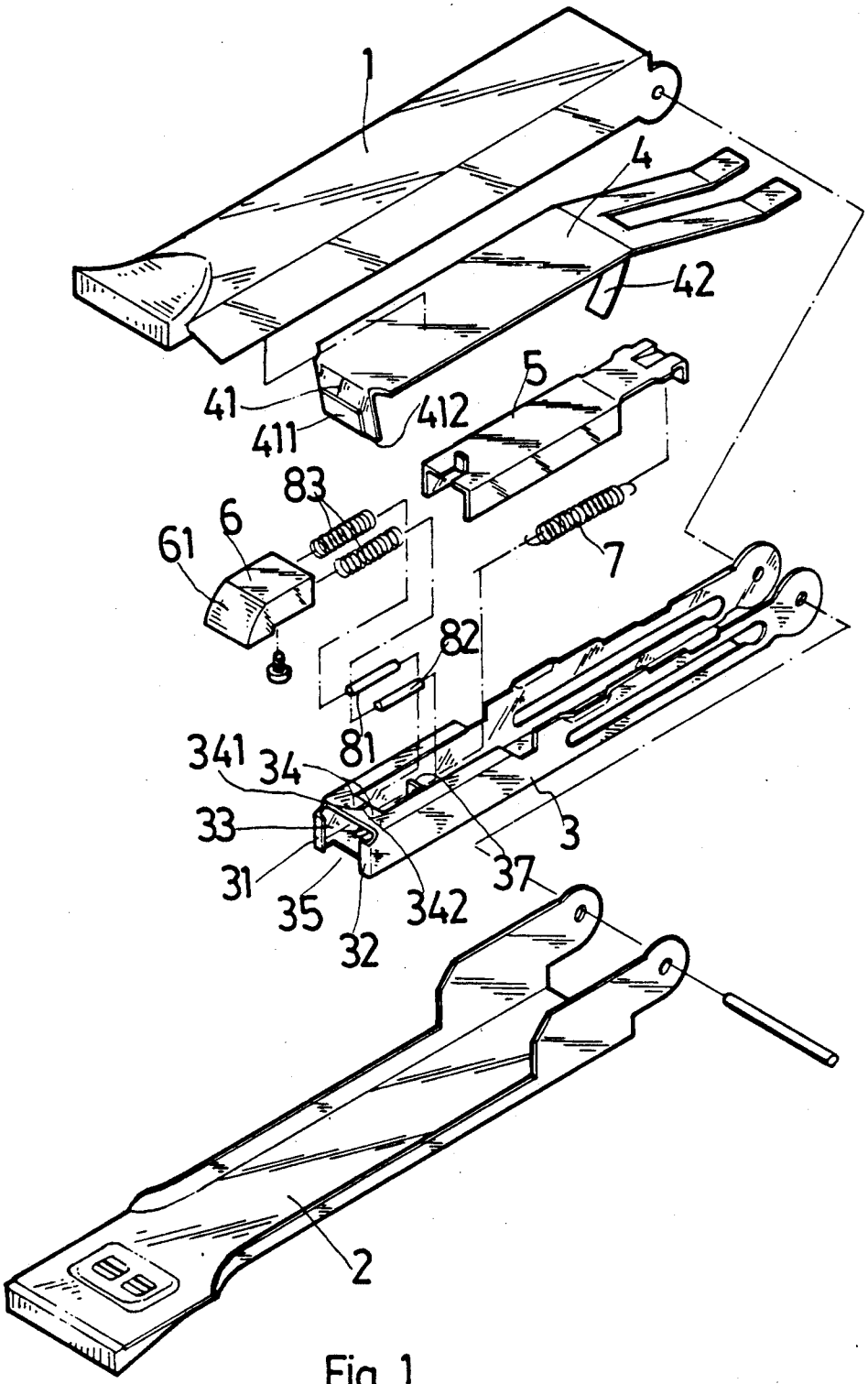
FIG. 1 is a perspective exploded view of a stapler constructed according to the present invention.
Figure 2:
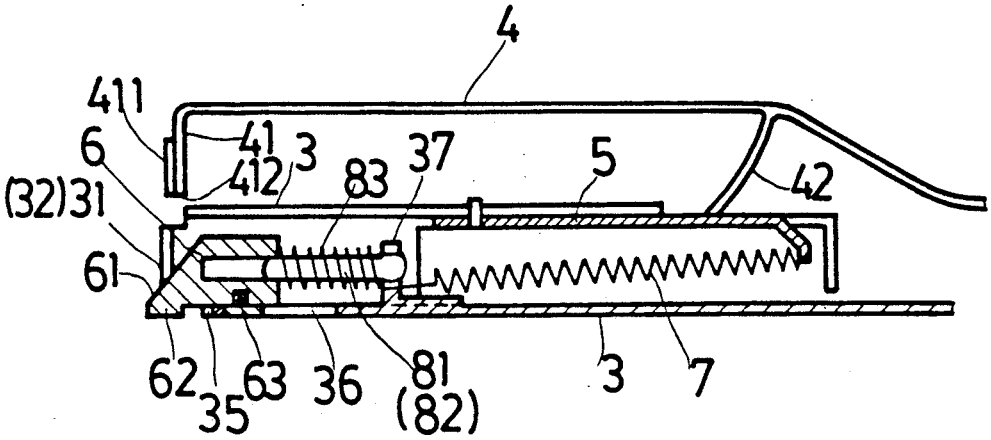
FIG. 2 is a side sectional assembly view of the stapler of FIG. 1.

Turning now to the annexed drawings in greater detail and first referring to FIGS. 1 and 2, therein illustrated is a stapler embodying the present invention and generally comprised of a pressure bar 1, a matrix base 2, a staple cartridge 3, a pressure plate spring 4, a feed slide 5, and a supporting wedge 6, wherein the pressure bar 1 and the matrix base 2 are similar to regular staplers and not the scope of the present invention.

As illustrated, a staple cartridge 3 of the present invention includes two front ends 31 and 32 respectively bent inward defining therebetween an opening 33 in width equal to the interval between the two side rods of any staple 9 to be used. The front upper portions of the two side walls of said staple cartridge 3 are respectively turned inward to form two projecting ends (34) connected together through a tongue 342 and a retaining groove 341 respectively made thereon. A setback notch 35 is made on the stable cartridge 3 at its front bottom end in size equal to said opening 33. An elongated slide hole 36 is made at the back of the notch 35. A seat 37 is set at the back apart from said elongated slide hole 36. A spring 7 is connected to said seat 37 at the back side with its opposite end secured to a feed slide 5. Two guide rods 81 and 82 are respectively secured to said seat 37 and mounted with two return springs 83 respectively. Said return springs 83 have their front ends respectively connected to a supporting wedge 6 which is movably mounted on said guide rods 81 and 82. Said feed slide 5 has a structure similar to a conventional stapler and is received in said staple cartridge 3 at the back end.

A pressure plate spring 4 is set in a pressure bar 1, which pressure plate spring 4 comprises a front striking plate 41 having secured thereto a front bumper 411 in size relatively smaller than said opening 33. Said front bumper 411 has its bottom end disposed at a level lower than said front striking plate 41 to define therewith a stepped bottom surface 412. An unitary push rod 42 is extending downward and inward from said pressure plate spring 4 at the rear end and made through punching and bending process. During assembly, said striking plate 41 is inserted in said opening 33 and said push rod 42 is pressed on said feed slide 5 at the rear upper end.

Said supporting wedge 6 comprises a wedge-like front end 61, two connecting holes 62 at its back side for setting therein of said two guide rods 81 and 82, a bottom projection 63 at its front bottom end in thickness equal to the bottom surface of said staple cartridge 3, and a positioning bolt 64 on its bottom at the back of said bottom projection 63. Said supporting wedge 6 is properly made in such a size that when it is placed in said staple cartridge 3, staples 9 or said feed slide 5 can be mounted on the gap formed between said supporting wedge 6 and the two side walls of said staple cartridge 3. During assembly, said wedge-like front end 61 of said supporting wedge 6 is disposed to protrude beyond said opening 33, said bottom projection 63 is set in said setback notch 35, and said positioning bolt 64 is set in said elongated slide hole 36.

Figure 3:
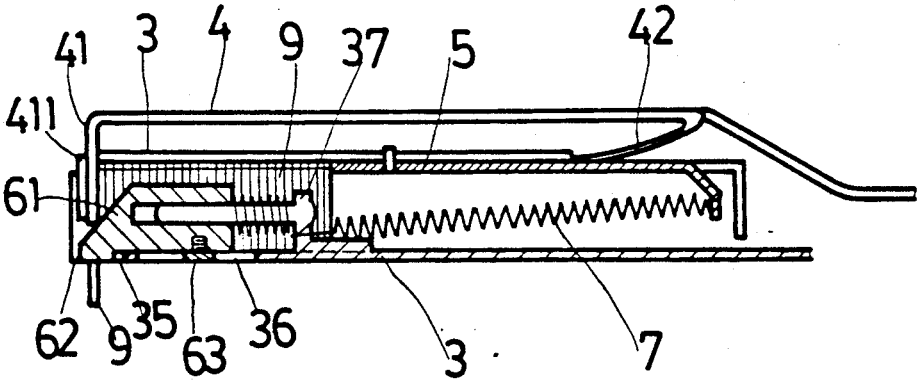
FIG. 3 is a sectional elevation of the stapler of FIG. 1 illustrating the operation to drive a staple.

Operation of the present invention is outlined hereinafter with reference made to the annexed drawings. Pull open said pressure bar 1 and said feed slide 5 for insertion of staples 9 in said staple cartridge 3. Then, push said pressure bar 1 and said feed slide 5 back to original position so as to push the inserted staples 9 to the front end of said staple cartridge 3 in a ready position for striking (as illustrated in FIG. 2). When said pressure bar 1 is pressed down, the front striking plate 41 of said pressure plate spring 4 is simultaneously pushed to drive the front piece of the inserted staples 9 to move downward through said opening 33. During downward striking, the wedge-like front end 61 is forced by the upper cross rod of the staple, which is driven to move downward, to gradually retreat along said guide rods 81 and 82 so that staple can be smoothly driven out of said staple cartridge 3 for binding. As illustrated in FIG. 3, a staple 9 is driven to strike downward. During downward stroke, the front side and the upper side of the upper cross rod of such a staple which is driven downward are stably confined by said front striking plate 41 and said front bumper 411 of said pressure plate spring 4, the bottom side of the upper cross rod of such a staple is firmly supported by said wedge-like front end 61 of said supporting wedge 6, the front sides of the two vertical side rods of such a staple are stopped by said two front ends 31 and 32 of said staple cartridge 3, the two outer sides of the two vertical side rods of such a staple are confined by the bilateral inner walls of said staple cartridge 3, and the two inner sides of the two vertical side rods of such a staple are supported by said supporting wedge 6, the back sides of the upper cross rod and the two vertical side rods of such a staple are firmly supported by the staples placed therebehind. Because the bottom projection 63 of said supporting wedge 6 has a thickness equal to the bottom surface of said staple cartridge 3, it is driven to smoothly slide backward on the paper to bind during staple striking process. Therefore, during operation, staples can be smoothly driven through papers for binding pamphlets.

In order to reinforce the strength of staples so that they can be efficiently driven through papers, the strength or structure of the two lateral side walls of the staple cartridge of a stapler must be reinforced or firmly supported. According to the present invention, this requirement is achieved by means of the connection between the tongue 342 and the retaining groove 341 of the two projecting ends 34 of the staple cartridge 3 of the present invention. Thus, the interval between the two side walls of the staple cartridge 3 of the present invention can be constantly maintained. Further, the push rod 42 of the pressure plate spring 4 of the stapler of the present invention is constantly pressed on the feed slide 5 thereof to push it forward and stop it from moving backward during staple driving process.

We claim:

1. A stapler, including a pressure bar;

a matrix base below said pressure bar;

a front-opened staple cartridge for setting therein of binding staples, said cartridge comprising two side walls having front ends which are respectively bent inward toward each other to define therebetween an opening, a bottom surface having mounted thereon a seat, a guide rod secured to said seat with a return spring mounted thereon;

a feed slide received in said staple cartridge and connected to said seat by a spring;

a pressure plate spring received in said pressure bar, said pressure plate spring comprising a front striking plate set in said opening of said staple cartridge; and a supporting wedge received in said staple cartridge to slide on said guide rod, said wedge comprising a wedge-like front end, and said wedge being made in such a size and width as to define a gap between said wedge and each said side wall of said cartridge, such that when said wedge is placed in said staple cartridge, binding staples or said feed slide can be mounted in said gap formed between said supporting wedge and said two side walls of said staple cartridge; said return spring extending between said seat and said wedge for urging said wedge forwardly:

wherein said pressure bar is pressed downward to force said front striking plate of said pressure plate spring to drive a staple received therein out of said opening and simultaneously to force said supporting wedge to gradually move backward against the force of said return spring, such that a staple is firmly confined by said front striking plate, said supporting wedge, and said two side walls of said staple cartridge to become stably driven downward to efficiently perform a paper binding process.

2. A stapler according to claim 1, wherein said opening which is defined between said two front ends of said staple cartridge has a width equal to the interval between the two vertical side rods of any staple to be used.

3. A stapler according to claim 1, wherein said side walls include upper front portions and said front upper portions of said two side walls of said staple cartridge are respectively turned inward to form two projecting ends which are respectively connected together.

4. A stapler according to claim 3, wherein said two projecting ends are connected through a tongue and a retaining groove respectively made thereon.

5. A stapler according to claim 1, wherein said staple cartridge comprises a setback notch at its front bottom end which is equal in size to said opening, and an elongated slide hole at the back of said notch; and said supporting wedge comprises a bottom projection at its front bottom end equal in thickness to the bottom surface of said staple cartridge, and a positioning bolt on the bottom of said wedge and at the back of said bottom projection, extending through said slide hole and slidable along said elongated slide hole.

6. A stapler according to claim 1, wherein said striking plate of said pressure plate spring has secured thereto a front bumper in size relatively smaller than said opening of said staple cartridge, said front bumper having its bottom end disposed at a level lower than said front striking plate so as to define therewith a stepped bottom surface.

7. A stapler according to claim 1, wherein said pressure plate spring comprises a unitary push rod extending downward and inward therefrom; said feed slide having a rear upper end on which said push rod constantly presses so as to push said slide forward during a staple driving operation.

8. A stapler according to claim 1, wherein there are two of said guide rods next to each other and secured to said seat and a respective said return spring on each of said guide rods.

9. A stapler according to claim 6, wherein said pressure plate spring comprises a unitary push rod extending downward and inward therefrom; said feed slide presses so as to push said slide forward during a staple driving operation.

* * * * *